United States Patent [19]

Cheng et al.

[11] Patent Number: 4,850,951

[45] Date of Patent: Jul. 25, 1989

[54] LID RETENTION APPARATUS FOR COVERAGE CENTRIFUGE ROTORS

[75] Inventors: David W. Cheng, Union City; Hugh O. Brown, Campbell, both of Calif.

[73] Assignee: Beckman Instruments, Inc., Fullerton, Calif.

[21] Appl. No.: 214,701

[22] Filed: Jul. 1, 1988

[51] Int. Cl.[4] ..... B04B 5/02

[52] U.S. Cl. ..... 494/16

[58] Field of Search ..... 494/85, 60, 61, 64, 494/38, 39, 16, 63; 210/781, 782, 360.1

[56] References Cited

U.S. PATENT DOCUMENTS 4,412,830 11/1983 Strain ..... 494/16

4,553,955 11/1985 Lam ..... 494/16

OTHER PUBLICATIONS

Blueprint Rotor Assy Ja-14/7/24/74/Beckman Instruments, Inc., Jul., 1974.

Instructions for using the JA-14 Fixed Angle Rotor in Beckman J-21 and J-S Series Centrifuges, Mar. 1988.

*Primary Examiner*—Robert W. Jenkins

*Attorney, Agent, or Firm*—William H. May; Paul R. Harder

[57] ABSTRACT

In a centrifuge rotor with defined and discrete sample receiving cells, an improvement to the fastening of a lid on top of the rotor by a bolt for preserving gas pressure on sample is provided. The rotor is of the type having a rotor body and rotor adaptor for attachment to a drive hub. Typically, a male control surface on the drive hub mates with a corresponding female mating surface on the rotor adaptor. The mating surfaces include paired opposed pins on the rotor adaptor received in grooves on the drive hub. A central aperture along the spin axis of the rotor is provided through the rotor body. This aperture is provided for viewing the rotor coupling at the pins to the grooves in the drive hub as well as providing a path through which a bolt can attach a lid on the top of the rotor to the drive hub with the rotor compressed therebetween the lid and drive hub, a sample preserving atmosphere may be maintained in the rotor during centrifugation. The invention comprises cantilevering a bushing from the lid down to the vicinity of the drive hub within the central aperture of the rotor body.

2 Claims, 3 Drawing Sheets

LID RETENTION APPARATUS FOR COVERAGE CENTRIFUGE ROTORS

BACKGROUND OF THE INVENTION

This invention relates to centrifuges. More particularly, in a well known prior art centrifuge rotor, a bushing is added to a lid assembly to end a recurrent and vexatious problem of occasional lid separation resulting in lid, rotor, and centrifuge damage.

Statement of the Problem

Centrifuges typically spin their respective rotors in a refrigerated chamber. To prevent rotor windage friction, the chamber is typically evacuated or placed under a vacuum. Unfortunately, the specimens undergoing centrifugation within the rotor cannot always be exposed to the vacuum without damage, such as dehydration. To prevent this specimen damage, a lid is utilized to maintain gas pressure, such as standard atmospheric pressure, during the centrifugation of the specimens.

This invention relates to a well known prior art rotor known as a J Fixed Angle Rotor sold by the Spinco Division of the Beckman Instruments Division of SmithKline Beckman Corporation and used on the J21 and J6 SmithKline Beckman centrifuges.

This prior art rotor with lid is illustrated in FIG. 1A.

A rotor R is shown having a plurality of cell receiving apertures 14, Apertures 14 are typically distributed round the axis 15 of the rotor in a symmetrical manner. Into these cell receiving apertures are placed tubes 16, which tubes 16 typically contain a sample 18 for centrifugation. During centrifugation, it is required that the rotor spin in a vacuum. Therefore, in referring to FIG. 1A and illustrated in broken lines, there can be seen a vacuum chamber 19. The function of vacuum chamber 19 is to evacuate the vicinity of the centrifuge so that windage is not present during high velocity rotor spinning.

Unfortunately, the vacuum can cause damage to the specimen 18 undergoing centrifugation. Usually, the vacuum causes undesired vaporization of the contents of the specimen, especially water. Accordingly, it is common to place a lid L to seal the rotor R.

The normal provision for the sealing of a rotor can be understood by first identifying the structure of the rotor R, lid L and the drive hub H of the centrifuge. Thereafter the normal procedure for the attachment of the lid L to the rotor R and drive hub H will be set forth. Finally, the casualty scenarios and prior art attempts at solution will be discussed.

Rotor R includes a rotor adaptor 20 keyed to a bore 24 in the rotor R at a key 26, The lower end of rotor adaptor 20 forms a conical female surface 28 which conical female surface mates with a complementary male conical surface 38 on drive hub H.

The rotor adaptor includes two opposed pins 30, These opposed pins are imbedded within mating holes in the rotor adaptor 20 and extend partially towards one another into the space occupied by the drive hub H at the truncated conical end of surface 38. It is the purpose of these pins to engage the rotor R to the drive hub H without slipping so that motor M (schematically illustrated) can rotate hub H and rotor R at high speeds within the evacuated chamber 19.

The theory of engagement can be easily understood. Centrally of the drive hub H there is contained a female threaded aperture 40. As will hereinafter be set forth, the purpose of the female threaded aperture 40 is to receive a bolt 50 maintaining a lid L on top of the rotor R.

At the same time and because of the presence of bolt 50, it will be understood that pins 30 cannot extend from one side of rotor adaptor 20 to the other side of the rotor adaptor 20. Instead, the pins are configured only part way across the rotor adaptor leaving a spatial interval therebetween for the placement of the bolt 50.

It is required that drive hub H transmit its rotation to rotor R substantially without slippage. Accordingly, the upward conical end of drive hub H is configured with four gathering surfaces 44, these surface being angularly separated with respect to the axis of the rotor at 90° intervals. Each pair of the gathering surfaces defines therebetween pin retaining grooves 46. Consequently, four pin retaining grooves are placed at 90° intervals around the drive hub.

Usually, each rotor comes equipped with only two opposed pins. These opposed pins fit into opposing grooves 46. The pins 30 extend a sufficient distance from the rotor adaptor 20 to enable engagement to the grooves 46. At the same time, the pins are sufficiently short to provide no interference with bolt 50 in its function of holding lid L in place.

In the rotor adaptor there is provided a central bore 22. Central bore 22 is used during installation of the rotor R on the drive hub H to view the engagement of pins 30 into grooves 46. After the installation of the rotor R on the drive hub H, this same aperture is thereafter utilized for placement of the bolt 50 to hold the lid L on the rotor R.

The construction of the lid L may be easily understood. Lid L is provided with an inverted dish construction that traps an O-ring 60 around a rim 64 at the upper periphery of rotor R within groove 62. A spacer 66 attached centrally to the lid L engages an inside annulus 69 and an O-ring 68 at a top extension 67 on the top of the rotor adaptor 20.

Bolt 50 is engaged centrally of a knob K, extends through spacer 67, a bushing 66, and is held to lid L by a key 72. The bolt is free to rotate with respect to the lid L.

It will thus be seen that in the assembly of a sealed rotor for centrifugation of samples 18, that there are two assemblies that must be brought together. These assemblies include the lid L and the rotor R which is to be sealed by the lid. The rotor assembly includes the rotor body R, sample tube 16, sample 18, and the adaptor 20. The lid assembly includes the lid L, knob K, bolt 50, spacer 66 and bushing 70, all held together by key 72 and bolt 50.

The normal procedure for the attachment of the lids L can be easily understood. With the lid L and attached components separated and free of the rotor R, the rotor R is lowered onto the drive hub H. This lowering occurs until pins 30 from drive hub adaptor 20 engage grooves 46 on the drive hub H.

In normal operation, the installing operator looks down the central aperture 22 in the rotor adaptor 20 during such installation. A restricted view of the pins 30 in engagement with the grooves 46 assists the installation of the rotor R to the drive hub.

At the same time it will be understood that should pins 30 land on top of the gathering surface 44 (rather than directly within the grooves 46) gathering will normally occur to grooves 46 on one side or the other side of the gathering surfaces 44. Alternately, the operator is instructed to provide relative rotation of the rotor R as it comes to rest on the drive hub H. This rotation occurs during lowering of the rotor R onto the drive hub H. Normally, this rotation, together with the view through the aperture 22 and the rotor adaptor 20 and the functioning of the gathering surfaces, usually assures proper rotor seating with pins 30 engaging grooves 46 on opposite sides of the drive hub H.

Once proper rotor seating has been assured, lid L is placed on top of the rotor. With the lid L in place on top of the rotor, bolt 50 is extended downwardly to and towards the threaded aperture 40 within the drive hub H. Bolt 50 is typically hand tightened utilizing a connection to knob K. This connection to knob K and hand tightening of bolt 50 using the expanded diameter of knob K assures proper tension of the bolt 50 on lid L assuring a sealing bias of the lid L onto the top of the rotor R at O-ring 60. With the lid firmly attached and typically sealing a standard atmosphere within the rotor R, centrifugation with a standard atmosphere trapped within rotor R can thereafter occur.

Despite these rather elaborate mechanical constructions, it is known that lids on such rotors become detached. It should be understood that when lids become detached, determining what has precisely caused the detachment is not trivial.

What remains after lid detachment is often a totally or partially destroyed centrifuge. This partially or totally destroyed centrifuge is most always remote from the site of centrifuge manufacture.

Bolt 50 is frequently bent or torn. Lid L ofttimes is destroyed. Usually the refrigerated chamber schematically shown at 19 in which the rotor is contained in an evacuated volume is damaged beyond repair and must be replaced. Sometimes, even the all metal rotor is destroyed. Frequently the drive hub H and even the attached drive motor M must be repaired or replaced. Because of the enormous amount of kinetic energy liberated in such a "rotor accident," determining what has happened at the time of the accident is far from obvious.

Admittedly, even experienced centrifuge operators can from time to time become careless. They can totally forget—under some circumstances—to tighten the rotor lid L to the rotor R. More often than not, the damage to the lid L and rotor R as well as the other components of the centrifuge, is so extensive that proof of an operator forgetting to tighten the lid L is completely obscured by the wreckage left in the wake of the casualty. Usually the manufacturer ends up sharing at least some of the cause for the casualty. This is so even though in all probability the casualty resulted from the operator's failure to follow instructions.

It should be understood that casualties are not frequent. Thus, tracing their pattern from infrequent events adds to the difficulty herein set forth.

With the type of prior art rotor illustrated in FIG. 1, one casualty scenario was laboriously identified by the prior art. Specifically, and with the placement of many rotors on a drive hub H, the gathering surfaces 44 at the drive hub H became other than smooth. These gathering surfaces 44 instead became roughened with the repeated, periodic contact with pin 30 under full weight of a sample filled rotor R. When the gathering surfaces were roughened, it was possible for pins 30 not to find grooves 46. Instead, pins 30 would remain perched on top of the surfaces 44. Thereafter, and thinking that the engagement was proper, the operator would tighten bolt 50 and lid L on rotor R.

Once the centrifuge was started, pins 30 would slip from their perch on gathering surfaces 44 and fall into grooves 46. Once this falling had occurred, bolt 50 and lid L would no longer be under tension. Instead, lid L would be free to move relative to rotor R. The initial scenarios of the separation of the lid L relative to the rotor R is set forth in the cartoon series of FIGS. 2A and 2B.

Referring to FIG. 2A. rotor R is shown after pins 30 have left gathering surfaces 44 and settled into grooves 46. A spatial interval I, exaggerated for purposes of this example, is shown between the rotor R and the lid L.

Referring to FIG. 2B, the rotor has been given increased angular velocity about its spin axis. In the frozen view of FIG. 2B, it can be seen that the centrifugal forces of the centrifuge precipitate the rest of the casualty. With spin, the inevitable imbalance of the lid L with respect to the rotor R is generated. Ultimately, either through bending or breaking of the centrifuge bolt 50, separation of lid L is usually followed by complete destruction of lid L and much of the centrifuge results.

An attempt was made in the prior art to control this type of casualty. This attempt was made by shortening bolt 50. The bolt 50 was shortened to a length that was insufficient to engage the drive hub H when pins 30 were on gathering surfaces 44. Where, however, the pins 30 found grooves 46, sufficient engagement of the bulb occurred to threaded aperture 32 within the drive hub H.

This shortening of the bolt was other than satisfactory. One problem was that in rare cases where permitted manufacturing tolerances would accumulatively add (and not cancel one another), tightening of the shortened bolt 50 with respect to a sufficient portion of the threaded aperture 32 was not possible. Further, as we will hereinafter disclose, for reasons that remained unidentified in the prior art, detachment of the lids L occurred.

Simply stated, the rotor here illustrated has been subject to occasionally casualties caused by separation of the lid L. These causalities have been relatively infrequent. However, whether the casualties are due either to operator error or latent defects precipitated from rotor construction added to operator error, their occasional reoccurrence requires correction.

Discovery

We have discovered and identified a phenomenon that is thus far remained unidentified in the centrifuge art which we believe is related in part to the precipitation of such lid detachment casualties. Specifically, and with reference to FIG. 4, we have examined the case where one cylindrical member, such as C2 is placed inside of another cylindrical member such as C1. Presuming that the inside cylindrical member C2 relatively gyrates with respect to the outside cylindrical member C1 with clearance between the two cylindrical members and insufficient penetration, an actual unscrewing of the two cylinders C1 and C2 is precipitated.

So that this phenomenon may be understood, a detailed description is supplied with respect to FIG. 4.

In making the following explanation, we are setting forth our best belief as to a contributing factor to these casualties. It is to be understood that other possible explanations may exist: however, this theory together with our new proposed design acts to reduce the occurrence of rotor lid casualty.

Taking the case of cylinder C2 placed interior of cylinder C1, this "unscrewing" effect can be set forth. If cylinder C1 is held stationary and cylinder C2 is rotated so that the outside surface of C2 scours the upper lid edge 80 of cylinder C1, it will be understood that cylinder C2 moves around within the clearance provided by the outside diameter of cylinder C2 and the inside diameter of cylinder C1. We have observed that edge 80 describes helical markings if cylinder C2 happens to be made of a relatively soft metal that can be impressed with a track of the scouring. Typically, the initial tracks 82 are helical and disposed like a thread on a machine screw with relatively small pitch or spatial separation at the beginning of the "unwinding" process. As the two cylinders C1 and C2 move apart, the pitch or spatial separation as shown at 83 becomes greater.

It will be understood that with such relative gyration between the cylinders C1 and C2, a rotation is permitted of cylinder C2 with respect to C1. Assuming that cylinder C2 is gyrated clockwise about the top of edge 80 of cylinder C1, a slight counterclockwise rotation of cylinder C2 relative to cylinder C1 can occur as shown by the arrows 85.

Most importantly, cylinder C2 acts not at all unlike a screw jack. Specifically, in such relative rotation, the helical threads at 82, 83 apply a force F directly upward. This force F tends to extract cylinder C2 from its engagement interior of cylinder C1.

We have also found that if cylinder C2 has sufficient penetration interior of cylinder C1, say to the depth of line 90 illustrated on the side of cylinder C2, such helical tracks as illustrated in 82. 83, do not form. These tracks instead remain as a solid line 90. Separation of the cylinder C1 from the cylinder C2 does not occur.

Returning to the scenario of FIG. 2B. we have discovered that the application of the forces illustrated in FIG. 4 can cause unscrewing of bolt 50 from threaded engagement interior of the drive hub H. Although we believe that this unscrewing is frequently and most always accompanied by operator error, it is apparent that correction, if possible, would be desired.

We are unaware of literature relating to centrifuges specifically identifying this problem, much less the designing away from this identified phenomenon illustrated in FIG. 4, This being the case, it will be apparent to the reader that the most difficult part of the disclosure herein has been to understand the problem that needs to be solved. Needless to say, insofar as the understanding of the problem that needs to be solved constitutes invention, invention is claimed.

While the example uses helical threads to illustrate the upward movement of C2 from C1, it must be understood that by no means is it necessary to have a thread-like groove on the inner cylinder for the unscrewing phenomena to occur. The helical grooves serve only to indicate the path taken by C2 as it climbs out of C1.

Non-rotational, circular, sliding movement of the lid assembly relative to the rotor, in the clockwise direction, will bear the bolt against the adaptor bushing (i.e., rotor body) with considerable force. The bolt, thus loaded, (in excess of 10.000 G). frictionally engaged with the adaptor bushing in a circular motion, imparts a torque sufficient to unscrew the bolt. The bolt unscrews itself by counter clockwise rotation.

SUMMARY OF THE INVENTION

In a centrifuge rotor with defined and discrete sample receiving cells, an improvement to the fastening of a lid on top of the rotor by a bolt for preserving gas pressure on sample is provided. The rotor is of the type having a rotor body and rotor adaptor for attachment to a drive hub. Typically, a male conical surface on the drive hub mates with a corresponding female mating surface on the rotor adaptor. The mating surfaces include paired opposed pins on the rotor adaptor received in grooves on the drive hub. A central aperture along the spin axis of the rotor is provided through the rotor body. This aperture is provided for viewing the rotor coupling at the pins to the grooves in the drive hub as well as providing a path through which a bolt can attach a lid on the top of the rotor to the drive hub. With the rotor compressed between the lid and drive hub, a sample preserving atmosphere may be maintained in the rotor during centrifugation. The invention comprises cantilevering a bushing from the lid down to the vicinity of the drive hub within the central aperture of the rotor body. It has been found that the cantilevered bushing prevents lid detachment even in cases of complete loosening of the lid securing bolt. Preferred ratios of the inside width of the aperture to the outside width of the bushing as well as depth of penetration of the bushing with respect to width of the bushing are given.

An object to this invention is to control lid separation casualties from rotors having a gas sealing lid securing a bolt, through an aperture to a drive hub. According to this aspect of the invention, a cantilevered bushing is attached to a bolt extending from the lid. The cantilevered bushing is given sufficient length and width with respect to a central receiving aperture in the rotor so that imbalance of the lid no longer causes helical extraction of the lid from the aperture in the rotor to precipitate a rotor casualty due to lid detachment. Specifically, the bolt and bushing occupy 95% or over of the diameter of the aperture and extend a distance of at least one and one-half aperture diameters into the central aperture. In calculation, a lower limit of penetration of 1.45 diameters has been indicated as sufficient to prevent separation.

An advantage of the new design is that even though a bolt does not fasten a lid to a rotor, separation of the lid from the rotor will not occur. Operator error in faulty bolt tightening does not cause casualty and damage. Only sample will be lost.

A serendipitous advantage of our discovery is that an easy modification of existing rotors can be made. Specifically, by the mere addition of a new bolt lock ring and extended bushing the recurrence of rotor lid separation casualties can be effected by field modification.

BRIEF DESCRIPTION OF THE DRAWINGS

Other objects, features, and advantages can be understood after referring to the previously referenced and hereafter described drawings in which:

Referring to FIGS. 3 and 5, a rotor precisely identical to that shown in FIG. 1A is shown with a new bolt 15', an elongate bushing 70' and a locating pin 72'. As can be seen relative to the rotor adaptor 20 and its central aperture 22 bushing 70' occupies 95% or over of the diameter of the aperture 20.

Figure 1A:
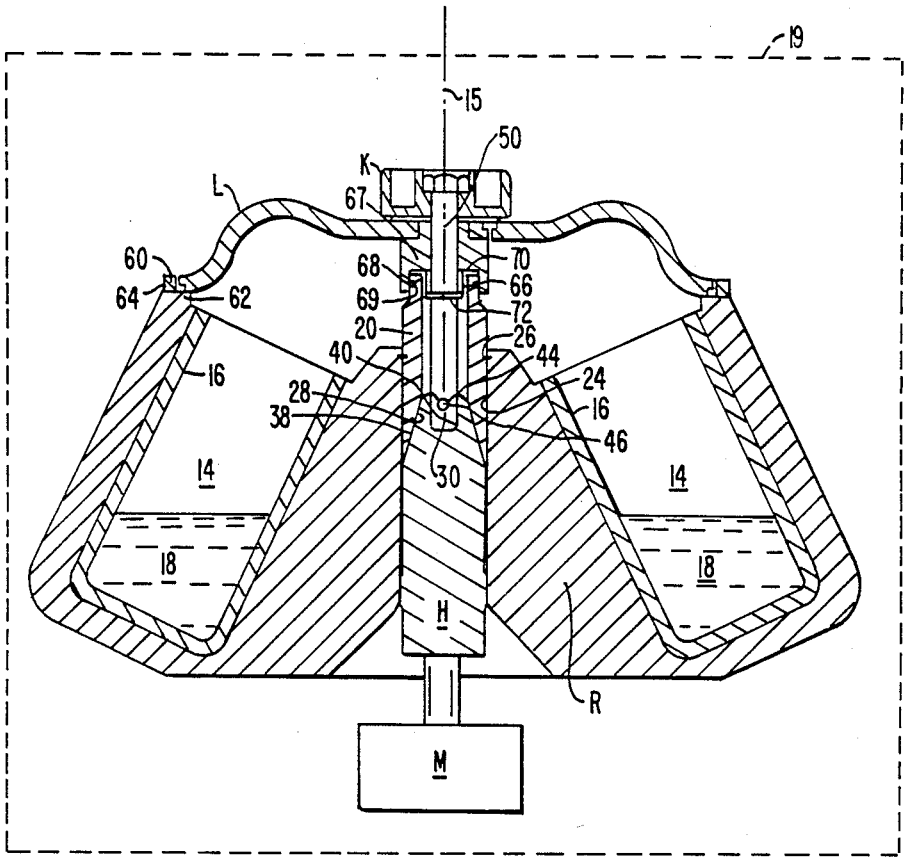
FIG. 1A. PRIOR ART
FIG. 1 is a side elevation of the prior art rotor including applicable schematics of a rotor mounted in an evacuated can for spinning on a drive hub H by a centrifuge motor M illustrating the prior art rotor and lid.
Figure 3:
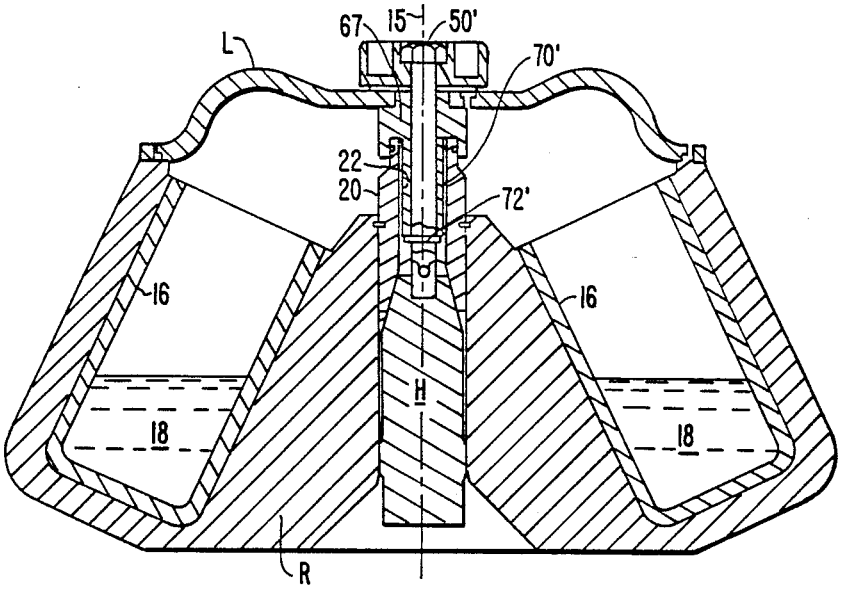
FIG. 3 is an illustration of the rotor of FIG. 1 with the addition of a bushing, retainer, ring and bolt to effect a field modification preventing the casualties illustrated in FIGS. 2A and 2B.
Figure 2A:
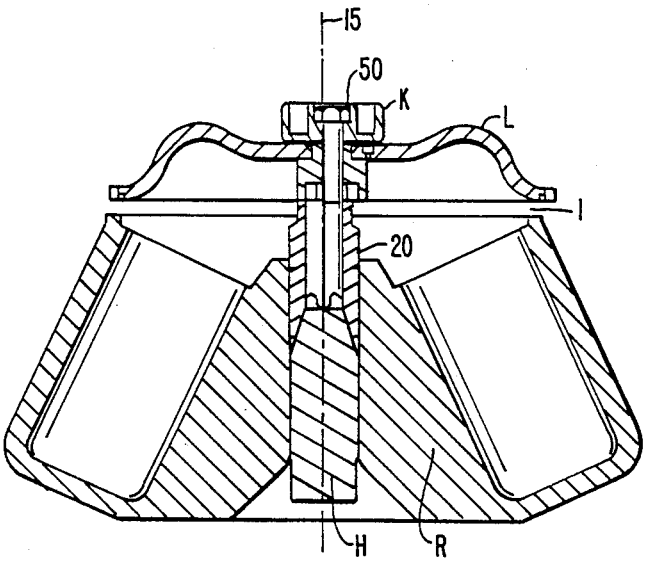
FIGS. 2A and 2B are serial schematics of a lid detachment rotor casualty the casualty illustrating the initial separation of the lid with respect to the rotor in FIG. 2A and the angular disposition of the lid during the casualty in FIG. 2B.
Figure 2B:
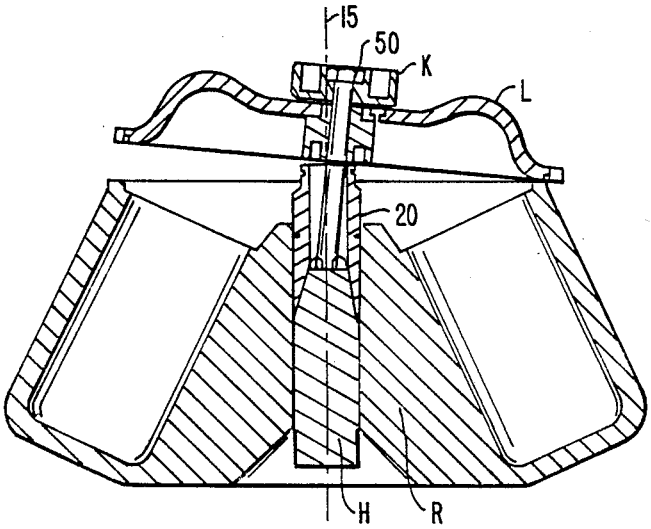
Figure 4:
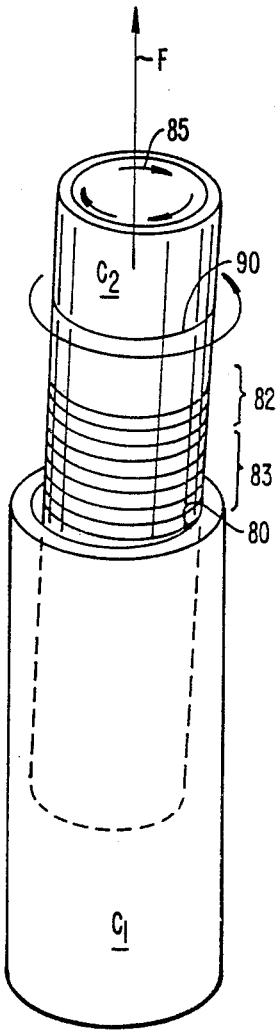
FIG. 4 is a theoretical illustration of the rotor separation cause which we have discovered; and, FIG. 5 is an expanded view of the rotor assembly of FIG. 3 illustrating the 95% or greater occupancy of the central aperture and the 1.45 diameter penetration to effect reduction of the lid casualty.
Figure 5:
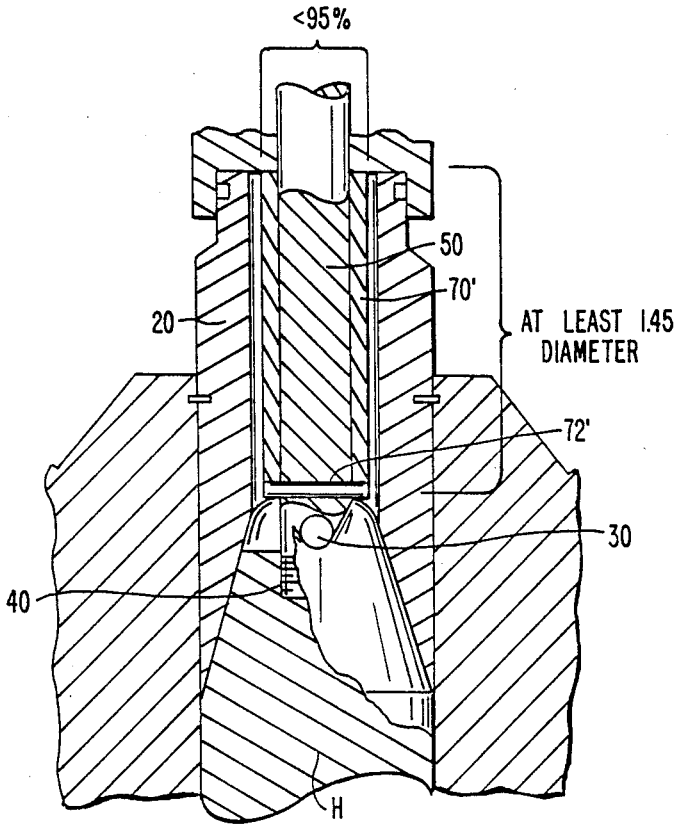

Bushing 70' is at least 1.45 times as long as the diameter of aperture 22. It has been found that adhering to or exceeding this at least 1.45 to 1 ratio with a 95% or greater occupancy of aperture 22 prevents the separation graphically illustrated in FIG. 4.

It will be understood, that locating pin 72'cantilevers bushing 70' to spacer 69 from lid L. Thus, even though bolt 50 is not attached to drive hub H. bushing 70' will maintain lid L centered with respect to rotor R so that lid separation does not occur.

It will be understood, that sample 18 within retainers 16 will be damaged. However, such loss of sample is preferred over any kind of rotor or centrifuge casualty.

Thus, it will be seen and understood that by the simple addition of a longer bushing, a vexatious and occasionally recurrent casualty has been eliminated from a well known prior art rotor design.

It will be further understood, that this disclosure conforms to operator ergonomics. Ergonomics, herein defined as the human machine interface recognize that human error, hopefully occasional, is nevertheless inevitable. The bushing addition here added neutralizes operator error in failure to tighten the bolt 50.

At the same time, it will be realized that the bushing and bolt replacement is extremely practical. While other solutions such as reversing the direction of the centrifuge or reversing the direction of the threads may have applicability, they are not practical.

We claim:

1. In a centrifuge rotor having:

a rotor body for rotation about an axis in a evacuated chamber;

a rotor adaptor connected to said rotor body at the lower portion thereof, said adaptor fitting within a defined cylindrical opening in said rotor body, said adaptor configured for attachment to said rotor at the upper end and configured for mating engagement to a drive hub from a centrifuge motor at the lower end;

a central aperture defined in said rotor adaptor along the axis of rotation of said rotor, said central aperture providing a view for observing connection of said rotor body to said drive hub and a continuous path for securing a lid by a bolt along said path over said rotor to said drive hub;

a plurality of sample receiving apertures defined in said rotor and exposed upwardly of said rotor for receiving and holding during said centrifugation sample to be classified;

a lid for placement over said sample receiving apertures on said central body of said rotor, said lid when subjected to pressure over the top of said rotor trapping gas within said rotor over said sample-receiving apertures to prevent escape of sample constituents during centrifugation;

a drive hub connected to a drive in said centrifuge for rotating said rotor, said drive hub making connection to said rotor body at said rotor adaptor at mating conical surfaces between the top of said drive hub and the bottom of said rotor adaptor;

a threaded aperture defined centrally of said drive hub:

said mating surfaces including a plurality of pins from said rotor adaptor extending into corresponding receiving grooves on said drive hub for the transfer of torque without slippage between said drive hub and rotor adaptor;

a bolt attached centrally of said lid and extending downwardly through the central aperture of said rotor body for threaded engagement with said threaded aperture of said drive hub of said rotor;

the improvement mounted to said bolt and extending from said lid comprising; bushing means surrounding said bolt and extending the diameter of said bolt to at least 95% the width of the central, aperture in said rotor adaptor, said bolt and diameter extending means having a cantilevered connection to said lid;

said bushing means having a penetration of said central aperture that is at least 1.45 times the diameter of said central aperture whereby said bushing as cantilevered from said rim does not undergo a helically engaged rotation with respect to the top of said central aperture in said rotor body.

2. A kit for the repair of a centrifuge rotor, said centrifuge rotor having a rotor body for rotation about an axis in an evacuated chamber;

a central aperture defined in said rotor body extending along the axis of rotation of said rotor; said central aperture providing a view to a connection of said rotor body to a drive hub in a path for securing a lid on said rotor to said drive hub by means of a bolt extending along said path;

a rotor adaptor connected to said rotor body at the lower portion thereof, said rotor adaptor defining a central aperture through said rotor along the axis of spin of said rotor, said adaptor configured for attachment to said rotor at the upper end and configured for attachment to a drive hub from a centrifuge drive at the lower end;

a plurality of sample receiving apertures defined in said rotor and upwardly exposed from the top of said rotor body for receiving and holding during centrifugation sample to be classified;

a lid for placement over said sample receiving aperture on the central body of said rotor, said lid configured when impressed at the top of said rotor to maintain gas pressure on said sample receiving apertures to prevent the escape of sample constituents during centrifugation:

a drive hub for connection to said rotor adaptor of said rotor for rotating said rotor, said drive hub making connection to said rotor body at mating conical surfaces between the top of said drive hub and the bottom of said rotor adaptor;

said mating conical surfaces including a plurality of pins from sad rotor adaptor extending in opposed relation to corresponding pin receiving grooves on said drive hub for the transfer of torque without slippage between said drive hub and the hub of said rotor adaptor;

a bolt attached centrally of said lid and extending downwardly through the central aperture of said rotor adaptor for threaded engagement to a defined aperture concentrically of the drive of said centrifuge;

a kit for preventing lid detachment comprising:

a bushing for surrounding said bolt, said bushing having a diameter to occupy at least 95% of the cylindrical aperture of said central aperture in said drive hub;

said bushing having a length with respect to the central aperture whereby said bushing penetrates said central aperture to a depth which is at least 1.45 times the overall diameter of said central aperture:

a bolt;

means for permitting a cantilevered attachment of said bolt and bushing with respect to said lid upon fastening of said key whereby said lid can remain centrally of said centrifuge rotor during spinning without tightening of said bolt.

* * * * *